US011945029B2

(12) United States Patent
Okada et al.

(10) Patent No.: US 11,945,029 B2
(45) Date of Patent: Apr. 2, 2024

(54) COLD FLAKE SUPPRESSION METHOD

(71) Applicant: Honda Motor Co., Ltd., Tokyo (JP)

(72) Inventors: Takeshi Okada, Tokyo (JP); Atsushi Yamashita, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/960,141

(22) Filed: Oct. 5, 2022

(65) Prior Publication Data

US 2023/0134954 A1 May 4, 2023

(30) Foreign Application Priority Data

Nov. 4, 2021 (JP) ..... 2021-180121

(51) Int. Cl.

| | |
|---|---|
| ***B22D 2/00*** | (2006.01) |
| ***B22D 17/20*** | (2006.01) |
| ***B22D 17/22*** | (2006.01) |
| ***B22D 17/32*** | (2006.01) |

(52) U.S. Cl.

CPC ..... *B22D 2/001* (2013.01); *B22D 17/203* (2013.01); *B22D 17/2272* (2013.01); *B22D 17/32* (2013.01)

(58) Field of Classification Search

CPC ..... B22D 2/00; B22D 2/001; B22D 17/20; B22D 17/203; B22D 17/32; B22D 17/22; B22D 17/2272

USPC ..... 164/4.1, 113, 303, 312; 75/375

See application file for complete search history.

(56) References Cited

U.S. PATENT DOCUMENTS

| | | | | |
|---|---|---|---|---|
| 2012/0048502 | A1* | 3/2012 | Anzai et al. ..... | B22C 9/105 164/520 |
| 2013/0000384 | A1* | 1/2013 | Yamaguchi et al. ... | B22D 2/006 73/31.04 |
| 2021/0268577 | A1* | 9/2021 | Matsuura et al. ..... | B22D 17/10 |

FOREIGN PATENT DOCUMENTS

| | | |
|---|---|---|
| JP | 2004506515 | 3/2004 |
| JP | 2007111728 | 5/2007 |
| JP | 2011143467 | 7/2011 |
| JP | 2019093441 | 6/2019 |

OTHER PUBLICATIONS

"Office Action of Japan Counterpart Application", dated Sep. 12, 2023, with English translation thereof, p. 1-p. 4.

* cited by examiner

*Primary Examiner* — Kevin P Kerns
(74) *Attorney, Agent, or Firm* — JCIPRNET

(57) ABSTRACT

A cold flake suppression method is provided. A molding device includes a sleeve, a tip, a sprue guide portion, a molding die, a sprue ring, a distributer, and a control device. The sprue guide portion includes a stamp portion, a runner portion, and a gate portion. The control device drives a supply device to slide the tip for molten metal to flow through the sleeve; sequentially calculates an amount of heat transfer changing continuously from the start of supply of molten metal until the tip slides to the position in FIG. 2, and calculates a total of the amounts as a total amount of heat transfer; and calculates a volume of the sprue guide portion based on information about the sprue guide portion input by an operator. Shapes of the sleeve and the sprue guide portion are determined to set a cold flake index equal to or less than 0.842.

4 Claims, 3 Drawing Sheets

| | Example 1 | Comparative Example 1 | Comparative Example 2 | Comparative Example 3 | Comparative Example 4 | Comparative Example 5 | Comparative Example 6 |
|---|---|---|---|---|---|---|---|
| Thickness of runner portion | X1 | X1 | X1 × 1. 667 | X1 | X1 | X1 | X1 |
| Thickness of stamp portion | X2 | X2 | X2 | X2 × 1. 65 | X2 | X2 | X2 |
| Length of runner portion | X3 × 2. 667 | X3 | X3 | X3 | X3 × 2. 300 | X3 × 2. 117 | X3 × 2. 450 |
| Stroke of tip | X4 × 0. 907 | X4 | X4 | X4 | X4 × 0. 899 | X4 × 0. 910 | X4 × 0. 891 |
| Volume of sprue guide portion | X5 × 1. 296 | X5 | X5 × 1. 230 | X5 × 1. 267 | X5 × 1. 233 | X5 × 1. 196 | X5 × 1. 259 |
| Total amount of heat transfer | X6 × 0. 936 | X6 | X6 × 1. 025 | X6 × 0. 904 | X6 × 0. 950 | X6 × 0. 956 | X6 × 0. 945 |
| Cold flake index | 0. 788 | 1. 044 | 0. 907 | 0. 881 | 0. 842 | 0. 871 | 0. 82 |
| Cold flakes flow into molding portion | No | Yes | Yes | Yes | No | No | No |
| Cold flakes flow into molding portion (under adverse conditions) | No | Yes | Yes | Yes | No | Yes | No |

Cold flake index = total amount of heat transfer / volume of sprue guide portion

FIG. 4

COLD FLAKE SUPPRESSION METHOD

CROSS-REFERENCE TO RELATED APPLICATION

This application claims the priority benefit of Japanese application serial no. 2021-180121, filed on Nov. 4, 2021. The entirety of the above-mentioned patent application is hereby incorporated by reference herein and made a part of this specification.

BACKGROUND

Technical Field

The disclosure relates to a cold flake suppression method.

Description of Related Art

It is widely known that injection molding casting is performed by supplying molten metal to a mold to manufacture a molded product, and in such a mold for molding, measures have been proposed to prevent cold flakes from entering the molded product (for example, see Patent Literature 1 (Japanese Patent Laid-Open No. 2004-506515)).

In Patent Literature 1, it is proposed to incorporate the flow in the shot sleeve into the model or incorporate the heat exchange between the die and the heat transferring fluid (HTF) into the model in casting of injection molding, so as to improve the accuracy of fluid flow for simulating the flow of fluid in the casting and molding process.

In Patent Literature 1, in order to use computer-aided engineering (CAE), there are problems that many parameters are required, it takes a lot of time to specify and input parameters, and it is necessary to secure expensive equipment for calculation and people versed in CAE.

SUMMARY

The cold flake suppression method of the disclosure is a cold flake suppression method for suppressing occurrence of cold flakes in an injection step in an injection molding device, which includes a sleeve of a cylindrical shape, a tip slidable in an axial direction within the sleeve from one end of the sleeve to the other end, a sprue guide portion which is disposed at the other end of the sleeve and in which a molten metal pressed by the tip in the sleeve and pushed out from the sleeve moves, and a molding die into which the molten metal moving through the sprue guide portion is injected to mold a product, and includes:

- a contact area estimation step of estimating a contact area between the sleeve and the molten metal per unit time;
- a total contact area estimation step of estimating an integrated value of the contact area per unit time estimated in the contact area estimation step;
- a cold flake index estimation step of estimating a cold flake index, which is a value obtained by dividing a total contact area estimated in the total contact area estimation step by a volume of the sprue guide portion; and
- a shape determination step of determining a shape of at least one of the sleeve and the sprue guide portion so that the cold flake index is equal to or less than a predetermined value.

BRIEF DESCRIPTION OF THE DRAWINGS

FIG. 4 is a diagram showing numerical values during casting of the first example and first to sixth comparative examples.

DESCRIPTION OF THE EMBODIMENTS

Figure 1:
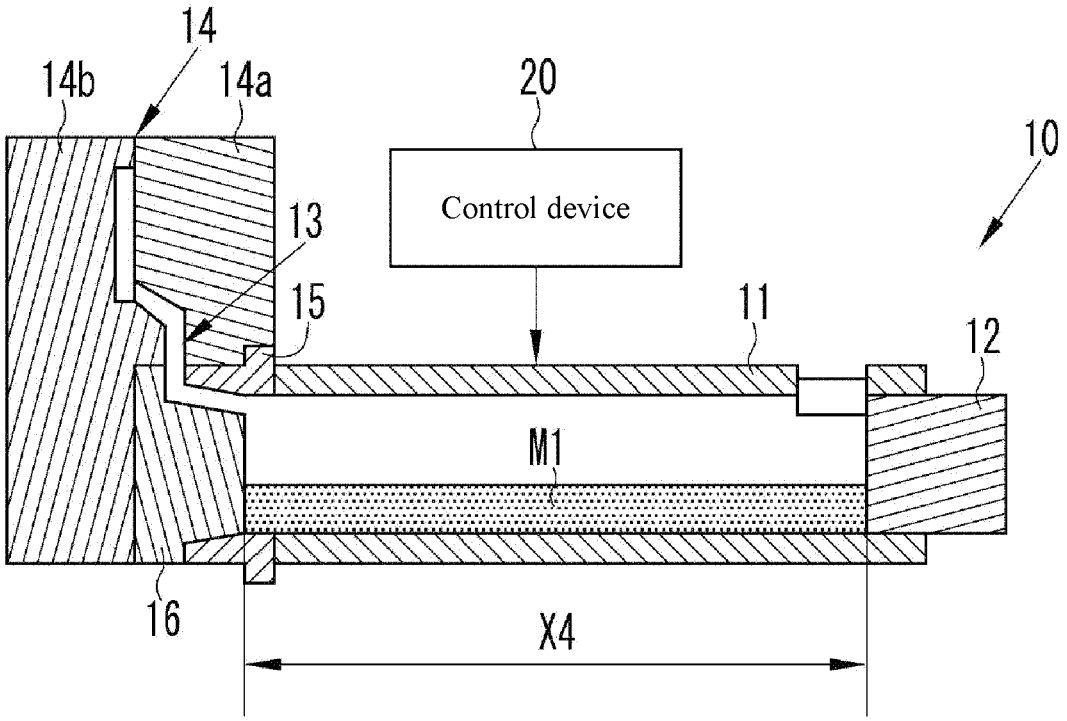
FIG. 1 is a schematic diagram showing a molding device according to an embodiment of the disclosure.

In view of such circumstances, the disclosure is intended to provide a cold flake suppression method, which can easily suppress the inclusion of cold flakes in a molded product.

The cold flake suppression method of the disclosure is a cold flake suppression method for suppressing occurrence of cold flakes in an injection step in an injection molding device, which includes a sleeve of a cylindrical shape, a tip slidable in an axial direction within the sleeve from one end of the sleeve to the other end, a sprue guide portion which is disposed at the other end of the sleeve and in which a molten metal pressed by the tip in the sleeve and pushed out from the sleeve moves, and a molding die into which the molten metal moving through the sprue guide portion is injected to mold a product, and includes:

- a contact area estimation step of estimating a contact area between the sleeve and the molten metal per unit time;
- a total contact area estimation step of estimating an integrated value of the contact area per unit time estimated in the contact area estimation step;
- a cold flake index estimation step of estimating a cold flake index, which is a value obtained by dividing a total contact area estimated in the total contact area estimation step by a volume of the sprue guide portion; and
- a shape determination step of determining a shape of at least one of the sleeve and the sprue guide portion so that the cold flake index is equal to or less than a predetermined value.

As a result of intensive studies carried out by the applicant, it has been found that there is a relationship between the cold flake index, which is the value obtained by dividing the total contact area by the volume of the sprue guide portion, and the inclusion of the cold flakes in the molded product, more specifically, it has been found that when the cold flake index is equal to or less than a predetermined value, the inclusion of the cold flakes into the molded product is suppressed.

According to the cold flake suppression method of the disclosure, since the shape of at least one of the sleeve and the sprue guide portion is determined to set the cold flake index equal to or less than the predetermined value, it is possible to easily suppress the inclusion of the cold flakes in the molded product.

Further, it is preferable that the total contact area estimated in the total contact area estimation step is a total contact area from when the molten metal is poured into the sleeve until a movement speed of the tip which presses and moves the molten metal switches to a high speed.

According to this configuration, the residence time of the molten metal in the sleeve can be shortened, and the time required for molding can also be shortened.

Further, it is preferable that the sprue guide portion includes a stamp portion, a runner portion, and a gate portion, and a length of the runner portion is changed in the shape determination step.

According to the above configuration, since the length of the runner portion is changed in the shape determination step, the cold flake index can be easily set to be equal to or less than a predetermined value.

Hereinafter, embodiments of the disclosure are described with reference to the accompanying drawings.

Figure 2:
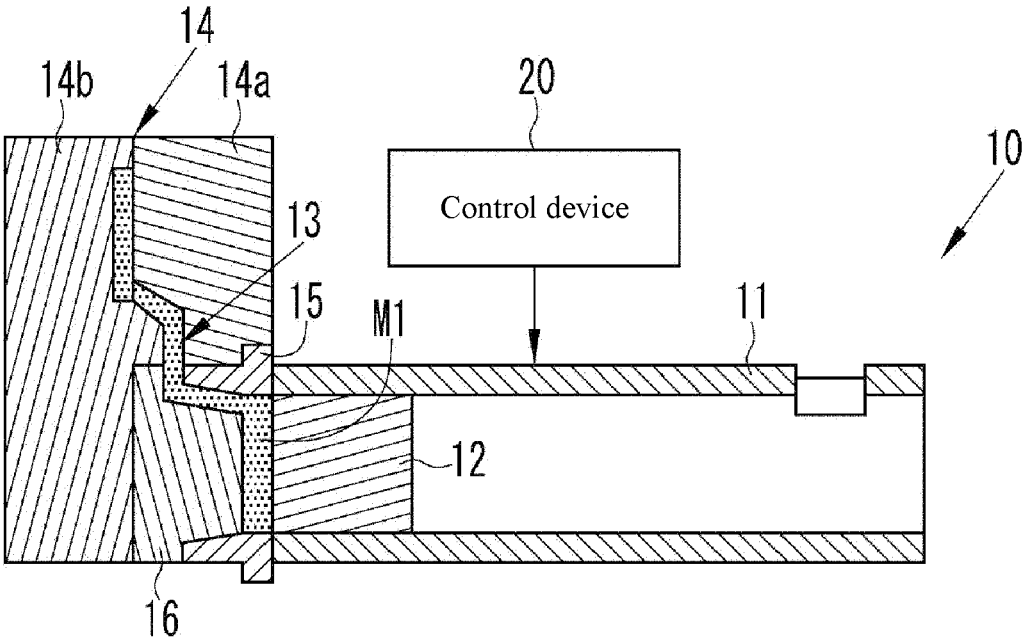
FIG. 2 is a schematic diagram showing a molding device with a tip sliding.
Figure 3:
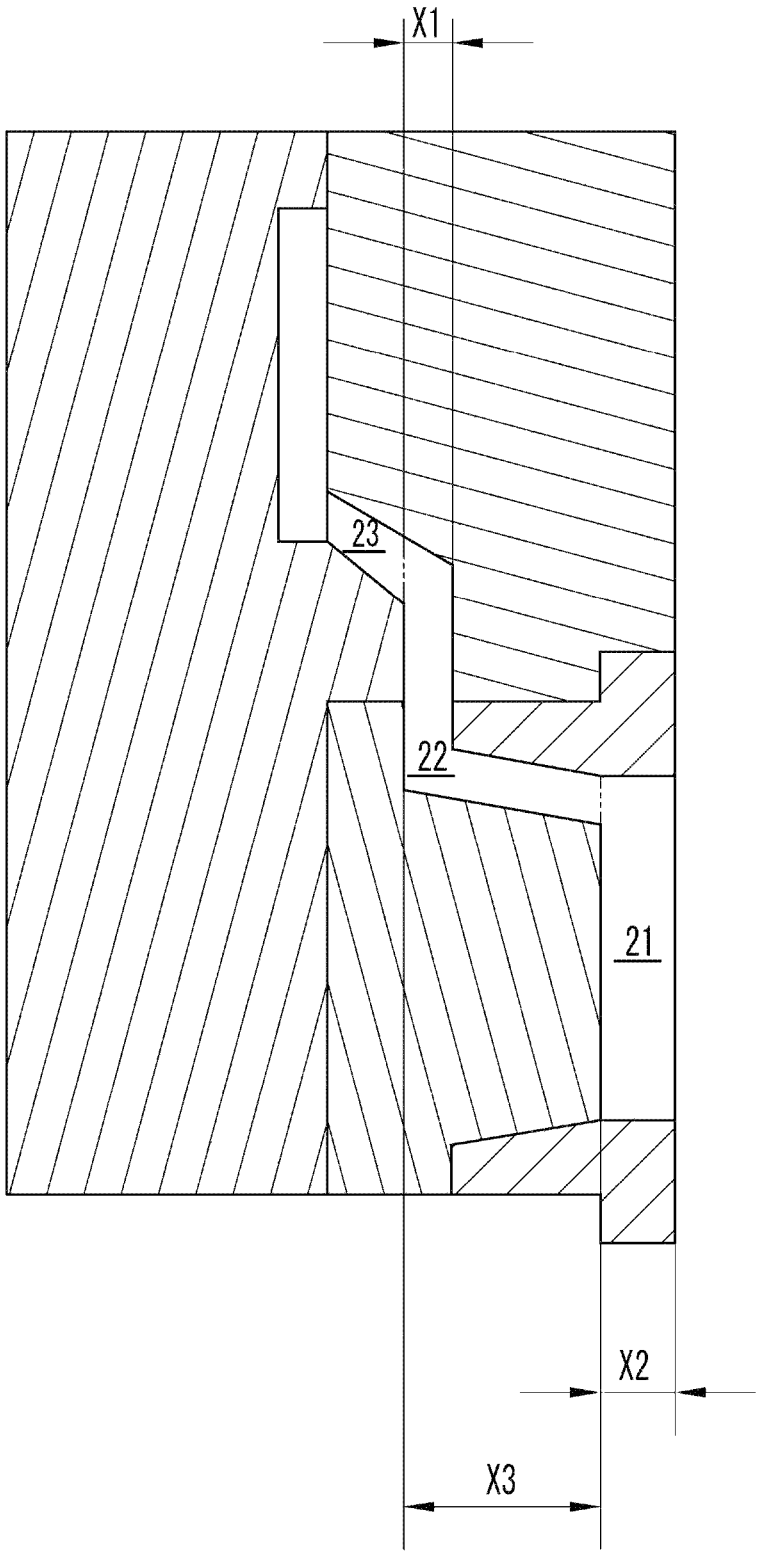
FIG. 3 is a schematic diagram showing a molding die, a sprue ring, and a distributer (DB).

As shown in FIGS. 1 to 3, a molding device 10 is a device for molding a molded product by, for example, injection molding molten metal M1 of aluminum. In the embodiment, for example, a casing for a transmission of a vehicle is molded as the molded product.

The molding device 10 includes a sleeve 11 of a cylindrical shape and a tip 12 that is slidable in the sleeve 11 in an axial direction (a left-right direction in FIG. 1) from one end (the right end in FIG. 1) to the other end (the left end in FIG. 1). The tip 12 is slid in the left-right direction in FIG. 1 by a sliding mechanism (not shown), and the driving (sliding) of the sliding mechanism is controlled by a control device 20 that controls the molding device 10 in an integrated manner. The molten metal M1 is supplied to the sleeve 11 by a supply device (not shown), and the control device 20 controls the driving of the supply device.

Further, the molding device 10 includes a sprue guide portion 13 which is disposed at the other end of the sleeve 11 (the left end in FIG. 1) and in which the molten metal M1 pressed by the tip 12 in the sleeve 11 to be pushed out from the sleeve 11 moves, a molding die 14 which molds a molded product by injecting the molten metal M1 that has moved through the sprue guide portion 13, a sprue ring 15, and a distributer (hereinafter referred to as DB) 16.

The molding die 14 includes a fixed die 14*a* that is fixed and a movable die 14*b* that can move in the left-right direction in FIG. 1, and the mold is clamped by moving the movable die 14*b* close to the fixed die 14*a*, and the mold is opened by moving the movable die 14*b* away from the fixed die 14*a*. In the embodiment, the mold is clamped by moving the movable die 14*b* rightward in FIG. 1, and the mold is opened by moving the movable die 14*b* leftward in FIG. 1. The movable die 14*b* is moved by a mold moving mechanism (not shown) driven by the control device 20.

The sprue guide portion 13 is formed of a stamp portion 21 also called a biscuit portion, a runner portion 22, and a gate portion 23 (see FIG. 3). The stamp portion 21 is formed of the sprue ring 15. The runner portion 22 is formed of the DB 16, the fixed die 14*a*, and the movable die 14*b*. The gate portion 23 is formed of the fixed die 14*a* and the movable die 14*b*. Further, the two-dot chain line in FIG. 3 is an imaginary line indicating the boundaries of the respective portions 21 to 23.

[Injection molding] When molding a molded product by the molding device 10, first, as shown in FIG. 1, the control device 20 drives the mold moving mechanism to move the movable die 14*b* to the right side in FIG. 1 for mold clamping. As a result, a molding portion, which is a hollow portion between the fixed die 14*a* and the movable die 14*b*, is formed.

Next, the control device 20 drives the supply device to supply the molten metal M1 of aluminum into the sleeve 11. In the embodiment, the control device 20 drives the supply device so that the molten metal flows through the sleeve 11 at, for example, 0.1 m/sec.

Then, as shown in FIG. 2, the control device 20 drives the sliding mechanism to slide the tip 12 leftward. By sliding the tip 12 to the left, the molten metal M1 in the sleeve 11 passes through the stamp portion 21, the runner portion 22, and the gate portion 23 of the sprue guide portion 13 and fills the molding portion of the molding die 14.

After the molten metal M1 filled in the molding portion of the molding die 14 is solidified, the movable die 14*b* is moved leftward in FIG. 1 to open the mold. Then, the molded product is removed from the molding die 14. In this way, a molded product is molded.

In the device for injection molding the molten metal M1 to mold a molded product, if cold flakes are mixed into the molded product, the molded product may become a defective product.

As a result of intensive studies, the applicant has found a method for suppressing the inclusion of cold flakes in the molded product.

In heat transfer, when heat transfer amount is Q (J), contact area is A ($m^2$), temperature difference is ΔT (K), heat flux is q ($W/m^2$), heat transfer coefficient is h ($W/m^2K$), and time is Δt (t), the following Formulas (1) and (2) are established.

$$Q=q\times A\times\Delta t \quad \text{[Formula 1]}$$

$$q=h\times\Delta T \quad \text{[Formula 2]}$$

In the molding device 10 of the embodiment, the molten metal M1 is controlled to flow through the sleeve 11 at 0.3 m/sec, and when the flow velocity of the molten metal M1 in the sleeve 11 is 0 to 0.1 m/sec, the heat transfer coefficient h ($W/m^2K$) is constant in the sleeve 11, or if the heat transfer coefficient h ($W/m^2K$) changes, the amount of change is small. In this way, the heat transfer coefficient h ($W/m^2K$) can be approximated by any constant.

In the molding device 10 of the embodiment, the temperature difference at each position in the left-right direction of the sleeve 11 during molding is small. In the molding device 10, the fluid initial temperature (pouring temperature) is regulated and managed, the temperature of the sleeve 11 on the heat-receiving side (before contact with the molten metal) reaches saturation during continuous casting and becomes constant, and the factor affecting the temperature distribution after contact with the molten metal is whether there is contact between the molten metal and the sleeve. That is, the temperature difference ΔT is replaced by a function of contact between the molten metal and the sleeve=contact area.

Thus, q in the above Formula (1) is a function of any constant×the contact area, and the heat transfer amount Q within the sleeve 11 expressed by Formula (1) can be approximated by the contact area per unit time.

Further, in the casting process, the control device 20 sequentially calculates the amount of heat transfer that changes continuously from the start of supply of the molten metal M1 until the tip 12 slides to the position shown in FIG. 2, and calculates a total of the amounts as a total amount of heat transfer. Moreover, the control device 20 calculates the volume of the sprue guide portion 13 based on various information (size) about the sprue guide portion 13 input by an operator.

As a new index for suppressing the inclusion of cold flakes in a molded product, the cold flake index represented by Formula (3) is to be described.

$$\text{Cold flake index}=\text{total amount of heat transfer/volume of sprue guide portion} \quad \text{[Formula 3]}$$

In the above Formula (3), as the total amount of heat transfer increases, the cold flake index also increases, and as the volume of sprue guide portion increases, the cold flake index decreases.

In the molding device 10, the shapes of the sleeve 11 and the sprue guide portion 13 are determined so that the cold flake index is equal to or less than a predetermined value (for example, 0.842).

As shown in FIGS. 1 and 3, in the embodiment, the thickness of the runner portion 22 is Xl, the length (thickness) of the stamp portion 21 is X2, the length of the runner portion 22 is X3, and the stroke length of the tip 12 is X4.

EXAMPLE

As shown in FIG. 4, experiments of casting by changing the shapes of the stamp portion 21 and the runner portion 22 of the sprue guide portion 13 and the stroke length of the tip 12 (Example 1 and Comparative Examples 1 to 3) were conducted by using the molding device 10.

In the above experiments, the control device 20 drove the supply device and slid the tip 12 at a constant speed from the position shown in FIG. 1 to the position shown in FIG. 2, so that the molten metal flowed through the sleeve 11 at 0.3 m/sec. Further, the control device 20 sequentially calculates the amount of heat transfer that changes continuously from the start of supply of the molten metal M1 until the tip 12 slides to the position shown in FIG. 2, and calculates the total of the amounts as the total amount of heat transfer. Moreover, the control device 20 calculates the volume of the sprue guide portion 13 based on various information (size) about the sprue guide portion 13 input by the operator.

In Example 1 and Comparative Examples 1 to 3, whether the cold flake index is equal to or less than 0.842 (condition 1), whether cold flakes do not reach the molding portion of the molding die 14 (condition 2), and whether cold flakes do not reach the molding portion of the molding die 14 under adverse conditions (condition 3) are determined.

The adverse condition is, for example, the case where the temperature of the sleeve 11 is lower than a predetermined temperature (for example, 100° C.). A state in which the temperature of the sleeve 11 has cooled due to a long period of casting suspension (for example, from the resumption of casting after the suspension of operation of the factory in which the molding device 10 is installed until the temperature of the sleeve 11 stabilizes after several shots are completed after mold preheating has been completed), the time immediately after the molding device 10 is resumed after being suspended for a short time due to maintenance or the like with a low temperature outside, such as winter, and so on fall under the above adverse conditions.

Example 1

In Example 1, the thickness of the runner portion 22 was X1, the length (thickness) of the stamp portion 21 was X2, the length of the runner portion 22 was X3×2.667, the stroke length of the tip 12 was X4×0.907, the volume of the sprue guide portion 13 was X5×1.296, and the total amount of heat transfer was X6×0.936. The above X1 to X6 are numerical values used in Comparative Example 1 below. In Example 1, the cold flake index was 0.788, so it was determined that condition 1 that the cold flake index is equal to or less than 0.842 was satisfied, condition 2 that cold flakes do not reach the molding portion of the molding die 14, was satisfied, and condition 3 that cold flakes do not reach the molding portion of the molding die 14 under adverse conditions, was satisfied. Further, the above length is the length of the left-right direction in FIG. 1.

Comparative Example 1

In Comparative Example 1, the thickness of the runner portion 22 was X1, the length (thickness) of the stamp portion 21 was X2, the length of the runner portion 22 was X3, the stroke length of the tip 12 was X4, the volume of the sprue guide portion 13 was X5, and the total amount of heat transfer was X6. In Comparative Example 1, the cold flake index was 1.044, so it was determined that condition 1 that the cold flake index is equal to or less than 0.842 was not satisfied, condition 2 that cold flakes do not reach the molding portion of the molding die 14 was not satisfied (cold flakes were mixed in the molded product), and condition 3 that cold flakes do not reach the molding portion of the molding die 14 under adverse conditions was not satisfied (cold flakes were mixed in the molded product).

Comparative Example 2

In Comparative Example 2, the thickness of the runner portion 22 was X1×1.667, the length (thickness) of the stamp portion 21 was X2, the length of the runner portion 22 was X3, the stroke length of the tip 12 was X4, the volume of the sprue guide portion 13 was X5×1.230, and the total amount of heat transfer was X6×1.025. In Comparative Example 2, the cold flake index was 0.907, so it was determined that condition 1 that the cold flake index is equal to or less than 0.842 was not satisfied, condition 2 that cold flakes do not reach the molding portion of the molding die 14 was not satisfied (cold flakes were mixed in the molded product), and condition 3 that cold flakes do not reach the molding portion of the molding die 14 under adverse conditions was not satisfied (cold flakes were mixed in the molded product).

Comparative Example 3

In Comparative Example 3, the thickness of the runner portion 22 was X1, the length (thickness) of the stamp portion 21 was X2×1.65, the length of the runner portion 22 was X3, the stroke length of the tip 12 was X4, the volume of the sprue guide portion 13 was X5×1.267, and the total amount of heat transfer was X6×1.025. In Comparative Example 3, the cold flake index was 0.881, so it was determined that condition 1 that the cold flake index is equal to or less than 0.842 was not satisfied, condition 2 that cold flakes do not reach the molding portion of the molding die 14 was not satisfied (cold flakes were mixed in the molded product), and condition 3 that cold flakes do not reach the molding portion of the molding die 14 under adverse conditions was not satisfied (cold flakes were mixed in the molded product).

Comparative Example 4

In Comparative Example 4, the thickness of the runner portion 22 was X1, the length (thickness) of the stamp portion 21 was X2, the length of the runner portion 22 was X3×2.300, the stroke length of the tip 12 was X4×0.899, the volume of the sprue guide portion 13 was X5×1.233, and the total amount of heat transfer was X6×0.950. In Comparative Example 4, the cold flake index was 0.842, so it was determined that condition 1 that the cold flake index is equal to or less than 0.842 was satisfied, condition 2 that cold flakes do not reach the molding portion of the molding die 14 was satisfied, and condition 3 that cold flakes do not reach the molding portion of the molding die 14 under adverse conditions was satisfied.

Comparative Example 5

In Comparative Example 5, the thickness of the runner portion 22 was X1, the length (thickness) of the stamp portion 21 was X2, the length of the runner portion 22 was X3×2.117, the stroke length of the tip 12 was X4×0.910, the volume of the sprue guide portion 13 was X5×1.196, and the total amount of heat transfer was X6×0.956. In Comparative Example 5, the cold flake index was 0.871, so it was determined that condition 1 that the cold flake index is equal to or less than 0.842 was not satisfied, condition 2 that cold flakes do not reach the molding portion of the molding die 14 was satisfied, and condition 3 that cold flakes do not reach the molding portion of the molding die 14 under adverse conditions was not satisfied (cold flakes were mixed in the molded product).

Comparative Example 6

In Comparative Example 6, the thickness of the runner portion 22 was X1, the length (thickness) of the stamp portion 21 was X2, the length of the runner portion 22 was X3×2.450, the stroke length of the tip 12 was X4×0.891, the volume of the sprue guide portion 13 was X5×1.259, and the total amount of heat transfer was X6×0.945. In Comparative Example 6, the cold flake index was 0.82, so it was determined that condition 1 that the cold flake index is equal to or less than 0.842 was satisfied, condition 2 that cold flakes do not reach the molding portion of the molding die 14 was satisfied, and condition 3 that cold flakes do not reach the molding portion of the molding die 14 under adverse conditions was satisfied.

Thus, by determining the shapes of the sleeve 11 and the sprue guide portion 13, so that the cold flake index is equal to or less than 0.842, cold flakes do not reach the molding portion of the molding die 14 so the defect rate of the molded product can be reduced.

In addition, when the length of the runner portion 22 was increased with respect to Comparative Example 1 to decrease the cold flake index (Example 1, Comparative Example 4, and Comparative Example 6), in comparison with the situation when the thickness of the runner portion 22 was increased with respect to Comparative Example 1 to decrease the cold flake index (Comparative Example 2), and the situation when the length (thickness) of the stamp portion 21 was increased with respect to Comparative Example 1 to decrease the cold flake index (Comparative Example 3), the cold flake index can be greatly reduced. From this, when the shapes of the sleeve 11 and the sprue guide portion 13 are determined, so that the cold flake index is equal to or less than 0.842, it is preferable and effective to increase the length of the runner portion 22 in order to reduce the cold flake index.

Further, in addition to the above Example 1, Comparative Example 4, and Comparative Example 6, many experimental results were obtained in which cold flakes did not reach the molding portion of the molding die 14 by setting the cold flake index to be equal to or less than 0.842. Moreover, in addition to Comparative Examples 1 to 3, many experimental results were obtained in which cold flakes reached the molding portion of the molding die 14 by setting the cold flake index to exceed 0.842. As for these experimental results, similar results were obtained with different molding devices for molding different molded products. Furthermore, in addition to Comparative Example 5, many experimental results were obtained in which if the cold flake index was set to slightly exceed 0.842 (approximately 0.87), condition 2 that cold flakes do not reach the molding portion of the molding die 14 was satisfied, but cold flakes reached the molding portion of the molding die 14 under adverse conditions (condition 3 was not satisfied). As for these experimental results, similar results were obtained with different molding devices for molding different molded products.

From the above, it has been found that the numerical value of the predetermined value (0.842) is effective when the shapes of the sleeve 11 and the sprue guide portion 13 are determined, so that the cold flake index is equal to or less than the predetermined value (for example, 0.842). Further, the predetermined value may be changed according to the structure and size of the molding device 10. Also in that case, the same experiments as described above are performed to determine the predetermined value.

Although the exemplary embodiment of the disclosure has been described above, as can be easily understood by those skilled in the art, the disclosure is not limited to such embodiment, and may be appropriately modified without departing from the scope of the disclosure.

For example, in the above embodiment, the control device 20 sequentially calculates the amount of heat transfer that changes continuously from the start of supply of the molten metal M1 until the tip 12 slides to the position shown in FIG. 2, and calculates the total of the amounts as the total amount of heat transfer. However, data on the total amount of heat transfer under different conditions may be stored in a memory (not shown) as experimental result data, and when the conditions are the same, data on the total amount of heat transfer under the same conditions may be read from the memory without performing the above calculation, and the data may be used as the total amount of heat transfer.

In the above embodiment, the control device 20 calculates the volume of the sprue guide portion 13 based on various information (size) about the sprue guide portion 13 input by the operator. However, the volume data of the sprue guide portion 13 obtained in advance may be stored in a memory for each type of information (size) about the sprue guide portion 13, and in the case of the sprue guide portion 13 with the same information, the volume data of the sprue guide portion 13 of the same information may be read from the memory without performing the above calculation, and the data may be used as the volume of the sprue guide portion 13.

Although the sleeve 11 of a cylindrical shape is used in the above embodiment, any tubular shape, for example, a triangular tubular shape or a square tubular shape, may be used.

In the above embodiment, the tip 12 is slid at a constant speed, but the speed may be switched to a high speed on the way. In this case, the total contact area to be calculated is the total contact area from when the molten metal M1 is poured into the sleeve 11 until the movement speed of the tip 12 switches to the high speed. In the embodiment, the residence time of the molten metal M1 in the sleeve 11 can be shortened, and the time required for molding can also be shortened.

Further, not all of the components shown in the above embodiment are necessarily essential, which may be appropriately selected or omitted without departing from the scope of the disclosure.

What is claimed is:

1. A cold flake suppression method for suppressing occurrence of cold flakes in an injection molding device, which comprises a sleeve of a cylindrical shape, a tip slidable in an axial direction within the sleeve from one end of the sleeve to the other end, a sprue guide portion which is disposed at the other end of the sleeve and in which a molten metal pressed by the tip in the sleeve and pushed out from the sleeve moves, and a molding die into which the molten metal moving through the sprue guide portion is injected to mold a product, the cold flake suppression method comprising:

a contact area estimation step of estimating a contact area between the sleeve and the molten metal per unit time;

a total contact area estimation step of estimating an integrated value of the contact area per unit time estimated in the contact area estimation step;

a shape determination step of determining a shape of at least one of the sleeve and the sprue guide portion so that a cold flake index is equal to or less than a predetermined value; and a cold flake index estimation step of estimating the cold flake index, which is a value obtained by dividing a total contact area estimated in the total contact area estimation step by a volume of the sprue guide portion.

2. The cold flake suppression method according to claim 1, wherein the total contact area estimated in the total contact area estimation step is a total contact area from when the molten metal is poured into the sleeve until a movement speed of the tip which presses and moves the molten metal switches to a high speed.

3. The cold flake suppression method according to claim 2, wherein the sprue guide portion comprises a stamp portion, a runner portion, and a gate portion, and a length of the runner portion is changed in the shape determination step.

4. The cold flake suppression method according to claim 1, wherein the sprue guide portion comprises a stamp portion, a runner portion, and a gate portion, and a length of the runner portion is changed in the shape determination step.

* * * * *